US005632337A

United States Patent [19]

Sundholm

[11] Patent Number: 5,632,337

[45] Date of Patent: May 27, 1997

[54] FIRE-FIGHTING EQUIPMENT

[76] Inventor: Göran Sundholm, Ilmari Kiannon kuja 3, FIN-04310 Tuusula, Finland

[21] Appl. No.: 244,213

[22] PCT Filed: Nov. 25, 1992

[86] PCT No.: PCT/FI92/00317

§ 371 Date: May 20, 1994

§ 102(e) Date: May 20, 1994

[87] PCT Pub. No.: WO93/10859

PCT Pub. Date: Jun. 10, 1993

[30] Foreign Application Priority Data

Nov. 26, 1991 [FI] Finland ..... 915574
Oct. 20, 1992 [FI] Finland ..... 924752

[51] Int. Cl.[6] ..... A62C 13/64

[52] U.S. Cl. ..... 169/9; 169/71; 169/72; 169/74

[58] Field of Search ..... 169/9, 71, 72, 169/74

[56] References Cited

U.S. PATENT DOCUMENTS 1,263,291 4/1918 Schultz ..... 169/9
2,799,466 7/1957 Hickerson ..... 251/282
2,967,570 1/1961 Nurkiewicz ..... 169/9

FOREIGN PATENT DOCUMENTS 0107837 5/1984 European Pat. Off. .
148858 6/1981 Germany ..... 169/71
14833 4/1926 Netherlands ..... 169/72
9100122 1/1971 WIPO .
9215370 9/1992 WIPO .
9222353 10/1992 WIPO .

*Primary Examiner*—Gary C. Hoge
*Attorney, Agent, or Firm*—Ladas & Parry

[57] ABSTRACT

In fire-fighting equipment having a drive unit for supplying extinguishing liquid, the drive unit is at least one hydraulic accumulator in which a high initial drive pressure falls to a reduced drive pressure in use. The hydraulic accumulator supplies only the extinguishing liquid at the high initial drive pressure and a mixture of the extinguishing liquid and a gas at the reduced drive pressure. For this, the hydraulic accumulator has a liquid space for the extinguishing liquid and a gas space for the gas that each communicate through an outlet valve with an outlet line for the use. The outlet valve responds to the high initial drive pressure and reduced drive pressure for opening only a liquid outlet connection at the high initial drive pressure and opening also a gas outlet connection at the reduced drive pressure.

7 Claims, 7 Drawing Sheets

FIRE-FIGHTING EQUIPMENT

The present invention relates to fire-fighting equipment, with a drive unit for extinguishing liquid.

To utilize at least one hydraulic accumulator, with a high initial charge pressure, as a drive unit for extinguishing liquid in fire-fighting equipment has been suggested in the international patent application PCT/FI92/00193, together with some preferable embodiments. A high initial charge pressure means in this context in general at least about 30 bar, but charge pressures of up to about 300 bar may well be considered.

Known hydraulic accumulators have a liquid space and a gas space separated from each other by a membrane. A relatively large portion of the volume of the hydraulic accumulator remains unutilized and, in addition, the penetration power of the liquid spray is reduced during a relatively long period when the hydraulic accumulator is being discharged at a reduced drive pressure.

The object of the invention is to provide a new fire-fighting equipment with an improved hydraulic accumulator enabling a more efficient fire-fighting.

The fire-fighting equipment according to the invention is mainly characterized in that the drive unit comprises at least one hydraulic accumulator, chargeable to a high initial drive pressure, and that the hydraulic accumulator is arranged to, at least at reduced drive pressure, deliver a mixture of liquid and gas.

The hydraulic accumulator can preferably be arranged to deliver liquid only at a high drive pressure and a mixture of liquid and gas at a reduced drive pressure.

In a preferred embodiment of the invention, the drive gas of the hydraulic accumulator is arranged to drive the accumulator liquid directly, without an intermediate membrane, the liquid being arranged to be driven out through a tube which starts at the bottom part of the liquid space of the accumulator and runs through the gas space of the accumulator to an outlet line.

The tube is provided with at least one aperture in its wall, at a desired distance from the outlet end of the tube at the upper end of the gas space, so that drive gas flows into the tube through said at least one aperture in the tube wall, when the liquid level in the hydraulic accumlator has sunk to said aperture, in order to boost the drive of extinguishing liquid.

In a preferred embodiment the tube is provided with a plurality of wall apertures at different levels, so that as the amount of liquid and the drive pressure of the hydraulic accumulator decrease the amount of drive gas mixed into the liquid increases.

The drive gas mixed into the extinguishing liquid results in a surprisingly good extinguishing effect for a surprisingly long time, i.e. it is possible to effectively utilize practically all of the liquid of a hydraulic accumulator in spite of a considerable pressure fall for the drive gas.

The foregoing preferred embodiment is, in addition, of a very simple structure and is thus very reliable.

A good automatic extinguisher is obtained with one single hydraulic accumulator. For e.g. automatic fire extinguishing installations with a need of greater capacity it is preferable to use a plurality of hydraulic accumulators in parallel. The hydraulic accumulators preferably have a common source of high pressure gas, e.g. a pressure bottle with nitrogen gas.

The nozzles included in the fire-fighting equipment are preferably made as presented in the international patent application PCT/FI92/00156, and the nozzles are preferably mounted in a spray head as presented in the international patent application PCT/FI92/00155, to produce a high pressure fog-like liquid spray with a good penetration power.

By a fog-like spray is meant a spray of small droplets having a diameter typically 30 to 100 microns and preferably set in a strong whirling motion. As earlier mentioned, by a high charge pressure is here in general meant from about 30 bar up to about 300 bar, as compared to an operating pressure of generally 2 to 10 bar in conventional sprinkler installations which produce a rain-like spray. It shall be noted, however, that the values given above are not absolute; definite limiting values are difficult to present.

Further preferred embodiments are defined in more detail in the patent claims and will also be described in the following, with reference to exemplifying embodiments shown in the attached drawing.

Figure 12:
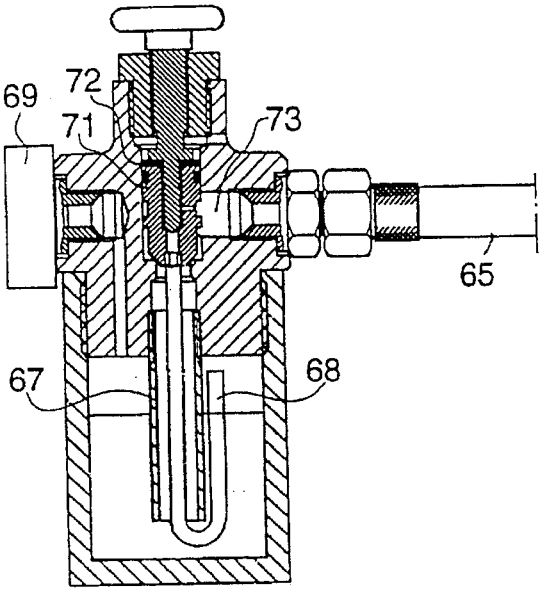
FIG. 12 shows the extinguisher in inactive state.
Figure 13:
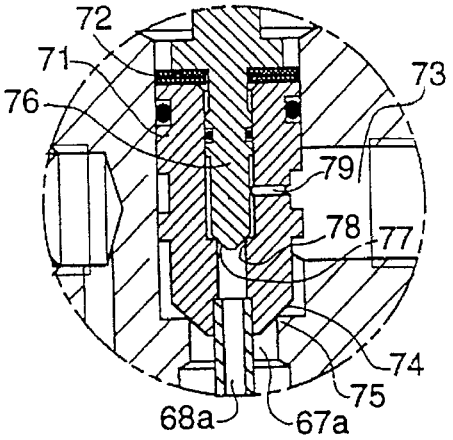

FIG. 13 the outlet valve of the extinguisher in detail, in the state of FIG. 12.

Figure 14:
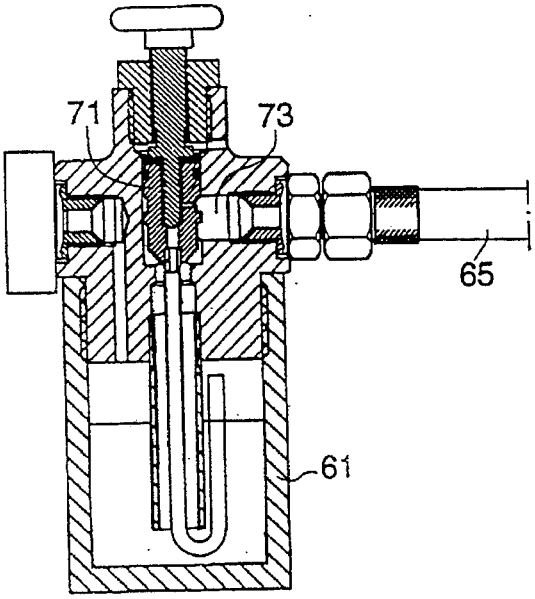

FIG. 14 shows the extinguisher in active state, with open liquid valve.

Figure 15:
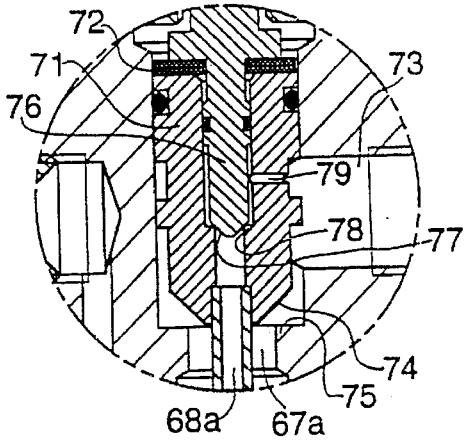

FIG. 15 shows the valve in detail, in the state of FIG. 14.

Figure 16:
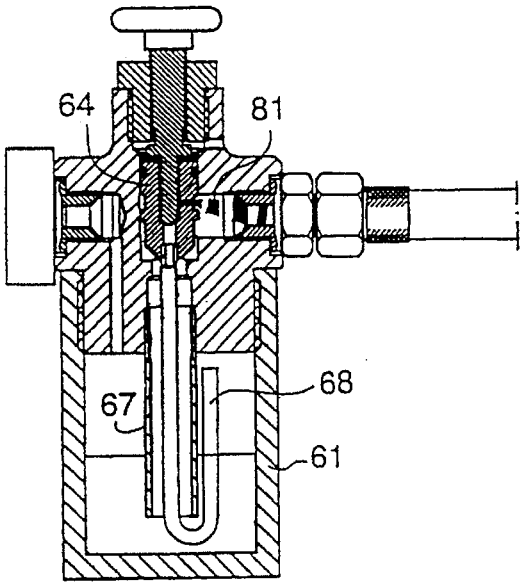

FIG. 16 shows the extinguisher in active state, with open liquid valve and open gas valve.

Figure 17:
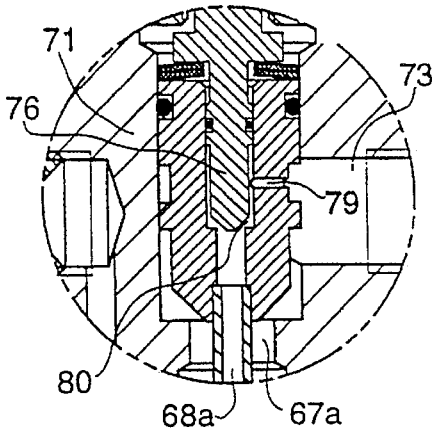

FIG. 17 shows the valve in detail, in the state of FIG. 16.

Figure 18:
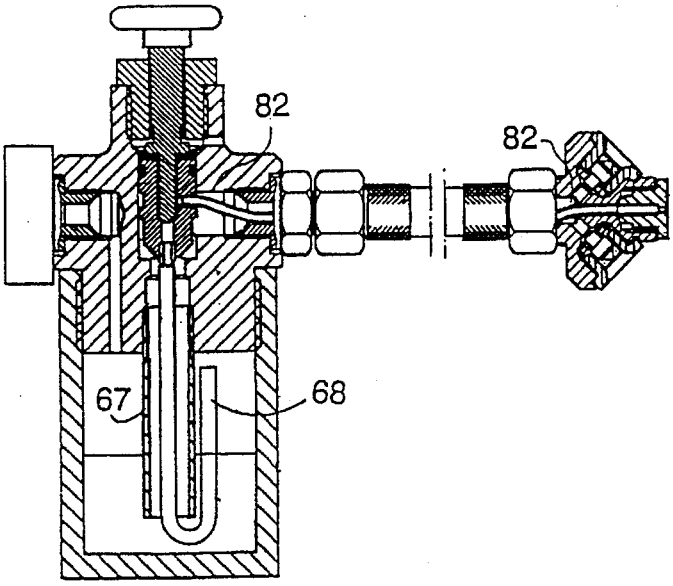
Figure 19:
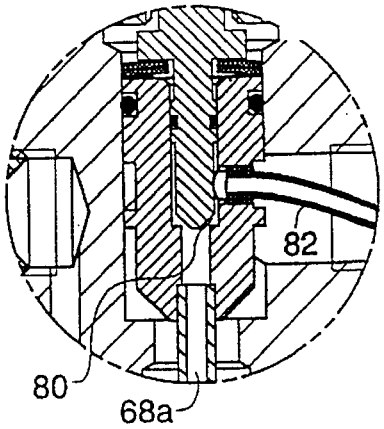

FIGS. 18 and 19 show an alternative embodiment in the same state as in FIGS. 16 and 17.

Figure 1:
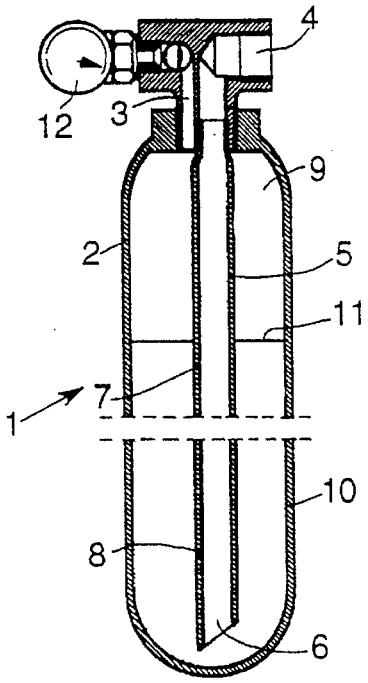
FIGS. 1, 2 and 3 illustrate how the invention works, in different stages.
Figure 2:
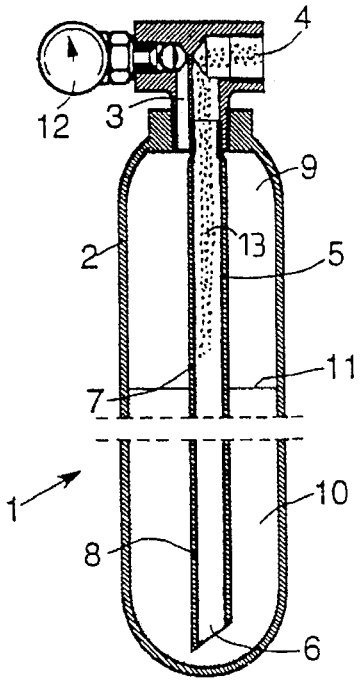
Figure 3:
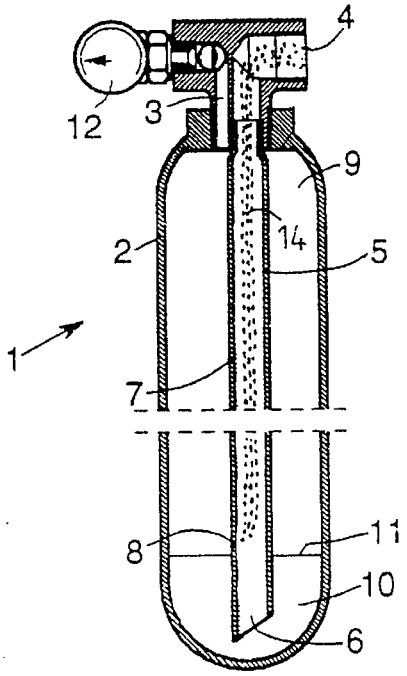

In FIGS. 1–3 a hydraulic accmulator is generally indicated by the reference numeral 1. The hydraulic accumulator comprises a pressure container 2 with an inlet 3 for compressed gas, e.g. nitrogen gas, and an outlet 4 for connection to an outgoing line or hose.

In the container 2 is arranged a tube 5 with an inlet 6 near the bottom of the container and with the opposite end connected to the outlet 4. The pipe 5 has two apertures 7 and 8 in its wall, at different levels in such a manner that the aperture 7 is relatively far from the tube inlet 6 whereas the aperture 8 is considerably closer to the tube inlet 6. The reference numeral 9 indicates a gas space, 10 indicates water, 11 indicates the water surface, or water level, and 12 indicates a manometer.

In the state of readiness, the container 2 is to a great extent filled with liquid, preferably water, i.e. the gas space is small and the gas pressure is high. An outlet valve provided in the outgoing line, not shown, is closed.

When the extinguisher is activated, the high pressure drive gas starts driving the water out through the pipe 5 to the outlet 4. The water level sinks in the container 2 whereas the gas space 9 becomes larger, correspondingly, and the gas pressure falls. In FIG. 1 the water level 11 has not yet reached the aperture 7 in the wall of the tube 5 and the hydraulic accumulator delivers water only.

In FIG. 2 the water level has passed the wall aperture 7 of the tube 5 and gas flows through the aperture 7 into the water flow, as indicated in FIG. 2 by gas bubbles 13. In FIG. 3 the water level has passed the second wall aperture 8 also, and more drive gas flows into the tube 5, as indicated by bubbles 14 in FIG. 3. It is of course possible to provide apertures in the tube wall at more than two levels and to provide a plurality of apertures at each level. In general the desired effect is accomplished by a few small apertures having a diameter of e.g. 1 to 2 mm. By mixing drive gas in this manner into the flow of extinguishing liquid it is possible to maintain an effective liquid spray until the container 2 is practically completely empty, whereat the pressure of the drive gas has fallen considerably. The pressure fall of the drive gas is in FIGS. 1–3 illustrated by the different positions of the indicator of the manometer 12. Since the tube 5 has wall apertures at a plurality of levels the amount of drive gas intermixed into the liquid flow increases as the gas pressure falls, and the increased amount of gas maintains the penetration power of the liquid spray.

Figure 4:
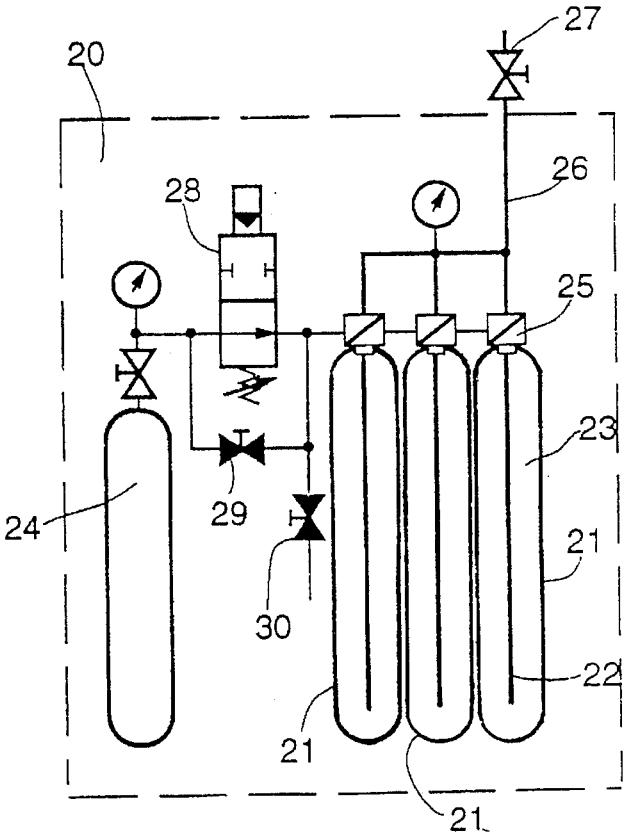
FIGS. 4, 5 and 6 show different preferred embodiments of the invention.
Figure 5:
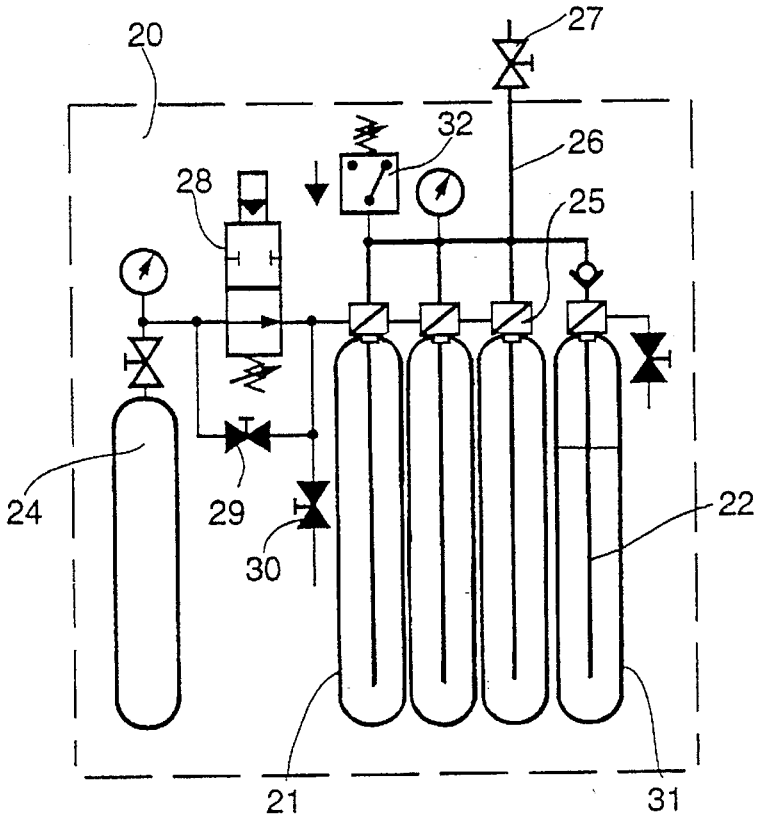
Figure 6:
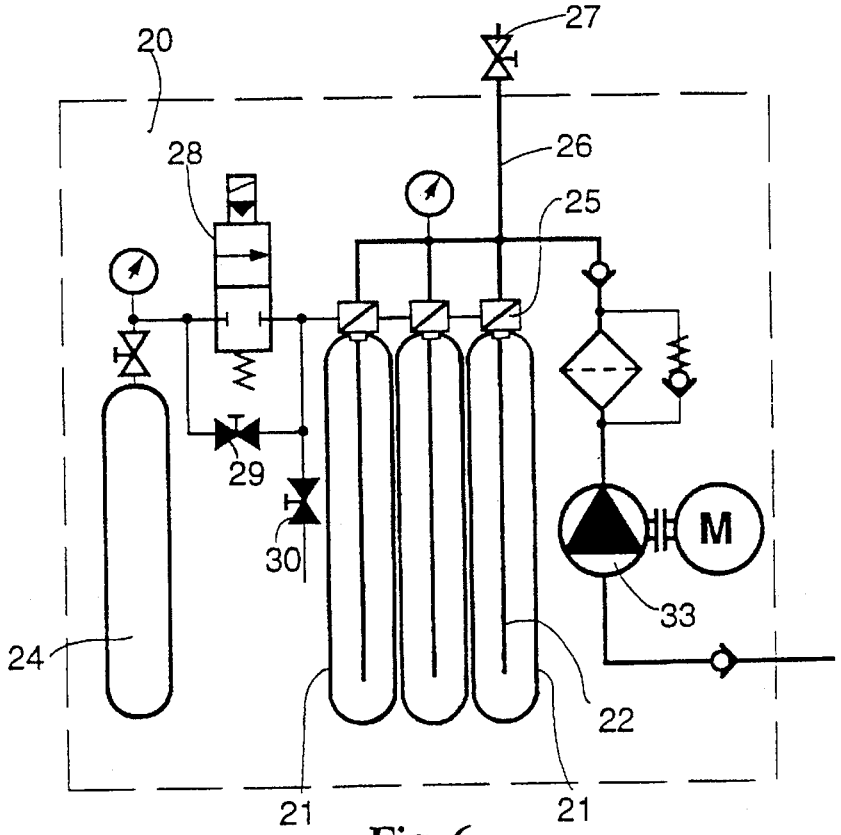

In the embodiments of FIGS. 4, 5 and 6, the drive unit of the fire-fighting equipment is generally indicated by 20. Three hydraulic accumlators are indicated by 21 and correspond to the accumlator 1 in FIGS. 1–3, each accumulator 21 thus comprising an inner tube 22 like the tube 5 in FIGS. 1–3, wall apertures included. The drive units 20 are in FIGS. 4–6 in a state of readiness, i.e. the accumulators 21 are filled with liquid, numeral 23 in FIG. 4.

A common source of drive gas for the hydraulic accumulators 21, in FIGS. 4–6 a pressure container with nitrogen gas and a charge pressure of about 200 bar, is indicated by 24. Connection means for gas into the accumulators and for liquid and a mixture of liquid and gas, respectively, out of the accumulators are indicated by 25, a common outlet line for the accumlators is indicated by 26 and a pilot valve therein is indicated by 27. An automatic, e.g. electrically operated pilot valve for connecting the gas container 24 is indicated by 28, a manually operable valve for the same purpose is indicated by 29 and a valve for filling and possibly emptying the accumulators is indicated by 30.

The drive unit of FIG. 4 works in the same way as has been described in the foregoing with reference to FIGS. 1–3.

The drive unit of FIG. 5 comprises an additional hydraulic accumlator indicated by 31 and in parallel with the accumulators 21, and like these having an inner tube 22 with wall apertures. The accumulator 31 has preferably nitrogen gas as drive gas, like the accumulators 21, but the charge pressure is relatively low, e.g. about 25 bar. This additional accumulator 31 is used for spraying liquid and a mixture of liquid and gas, respectively, through activated spray heads in the beginning of the extinguishing process, in order to cool these spray heads and secure that the lines to the spray heads are filled with liquid before commencing high pressure liquid spraying.

In the drive unit of FIG. 6, a liquid pump 33 takes care of cooling the spray heads and filling the lines to them before spraying high pressure liquid. The pump 33 can further be used for refilling the hydraulic accumulators when emptied, preferably with a simultaneous cooling spray to the fire seat.

Figure 7:
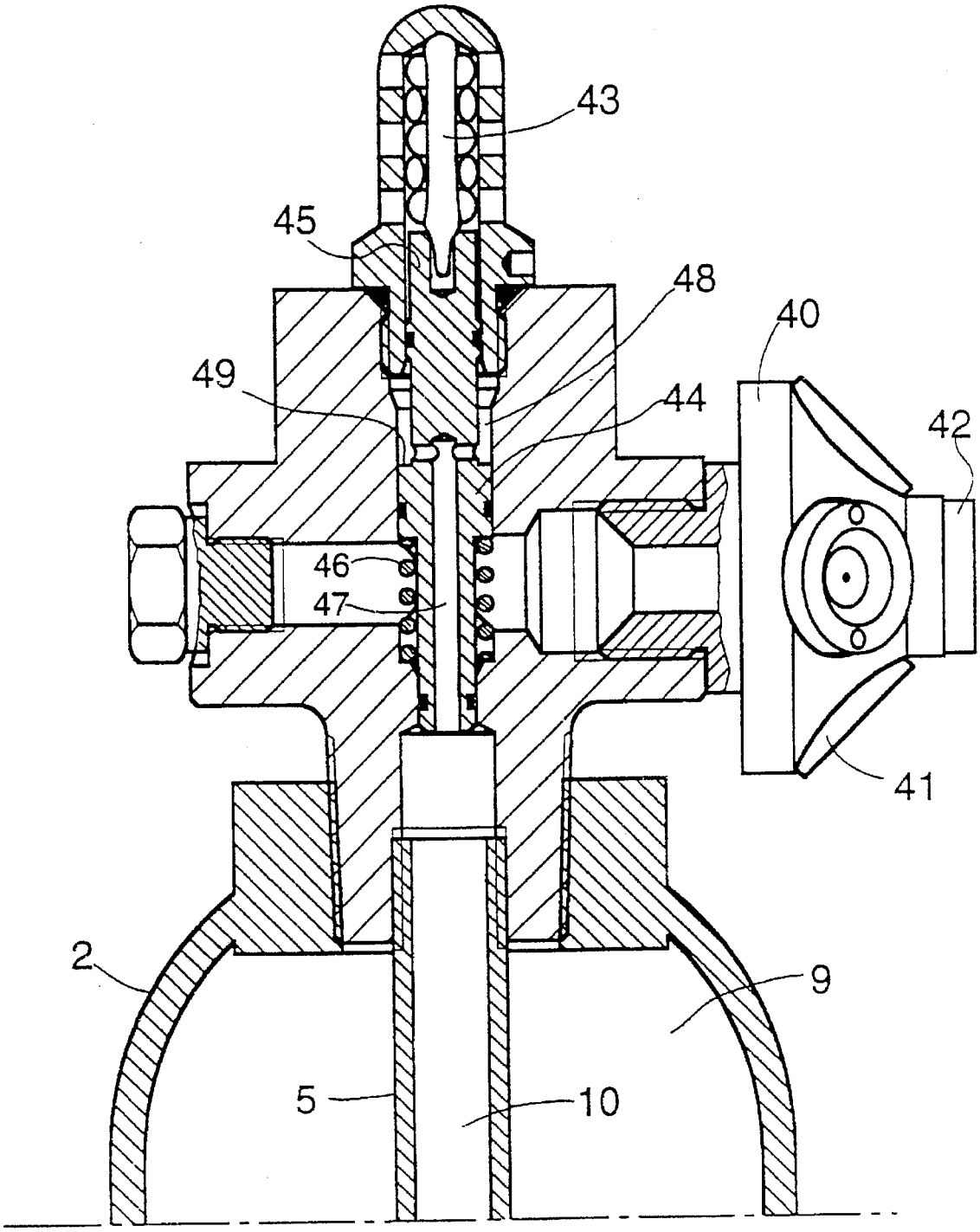
FIGS. 7–10 show alternative examples of release means.

In FIG. 7, numeral 40 indicates a spray head with four nozzles 41 directed obliquely to the sides and a central nozzle 42 in the forward direction. A release ampoule 43 is engaged by an end portion 45 of a valve spindle 44, said end portion being slidably positioned in the ampoule holder. The engagement is effected by a helical spring 46 around the valve spindle, the force of the spring being adjusted not to crush the ampoule 43 at normal temperature.

From that end of the valve spindle 44 which lies towards the outlet tube 5 of the container 2 extends an axial channel 47 to an annular chamber 48 with a cross section area so adjusted, that the pressure force acting on an end face 49 in the direction towards the valve spindle end at the outlet tube 5 balances that pressure force which acts from the tube 5 on said valve spindle end. A high charge pressure in the container 2 does therefore not damage the release ampoule prematurely.

The ampoule 43 breaks at an increased temperature, whereat the spring 46 presses the valve spindle 44 off the outlet tube 5 of the container 2 and opens connection from the tube 5 to the spray head 40.

Figure 8:
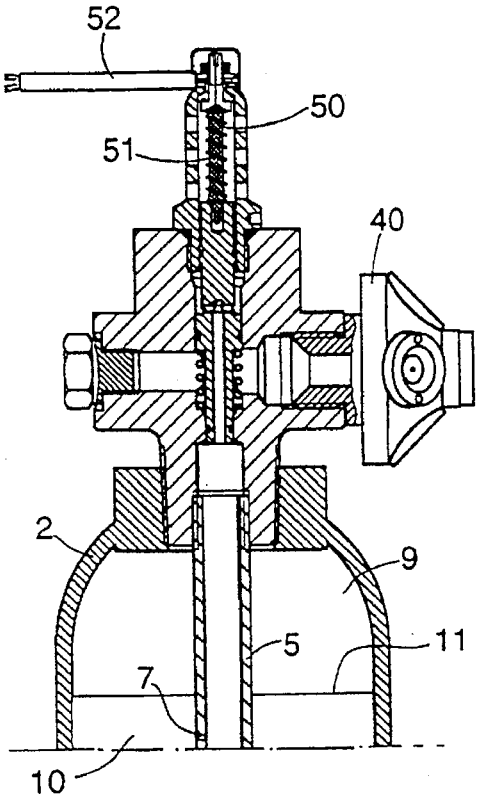
Figure 9:
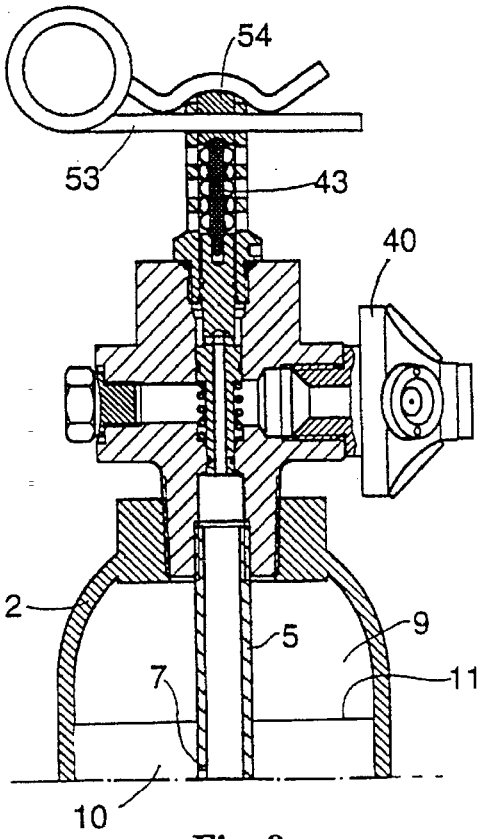
Figure 10:
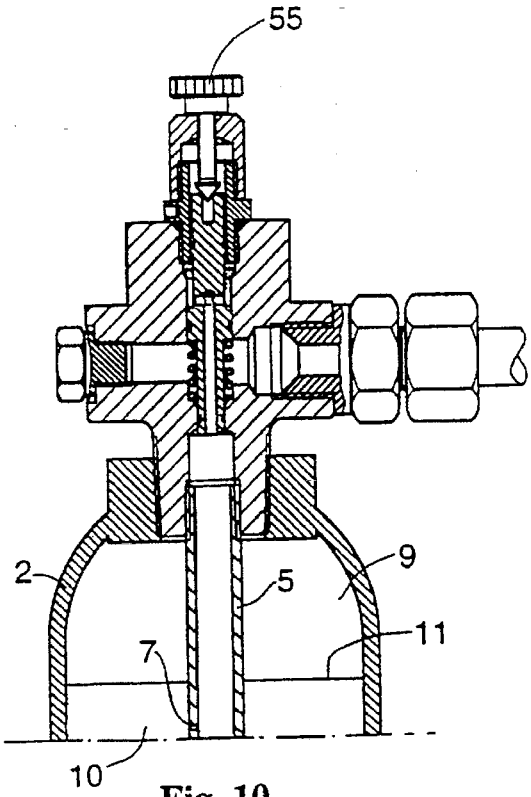
Figure 11:
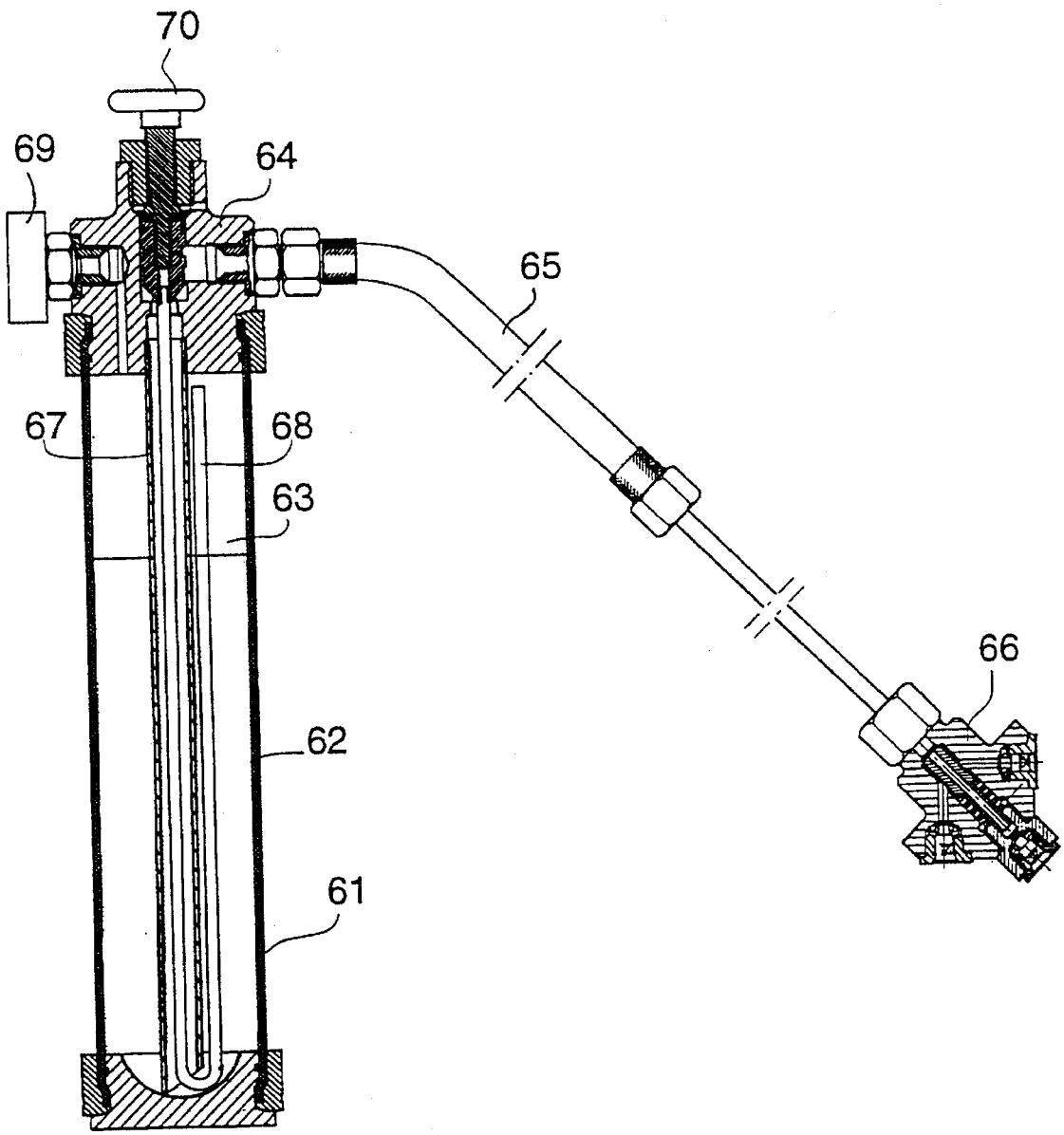
FIG. 11 shows a longitudinal section of a carriable fire extinguisher.

The embodiments shown in FIGS. 8, 9 and 10 all have a pressure compensating spindle structure like the one shown in FIG. 7. In FIG. 8, a heat sling 51 is arranged around a release ampoule 50, the electric feed line of the sling being indicated by 52. By means of the heat sling 51, the fire-fighting equipment can be activated faster, i.e. the ampoule 50 can be made to melt or weaken faster than what would be the case under the influence of the rising air temperature alone.

In FIG. 9, a manually releasable cotter pin is indicated by 53. When the pin 53 is released, a plug 54 is unblocked and is removed by the spindle mechanism via the ampoule 43.

In the embodiment shown in FIG. 10, the fire-fighting equipment is activated by loosening a holder screw 55, whereat the valve spindle follows under the influence of the helical spring 46.

In the following shall be described a carriable extinguisher, with reference to FIGS. 11 to 19.

The reference numeral 61 indicates a hydraulic accumulator container with a liquid 62 and pressure gas 63, of e.g. about 200 bar. An outlet valve is generally indicated by 64, an outgoing hose by 65 and a spray head connected to the hose by 66. The spray head 66 is preferably made as presented in the international patent application PCT/FI92/00155, with a number of nozzles directed obliquely to the sides and with one central nozzle in forward direction.

In the container 61 is arranged a tube 67 and within the tube 67 a second tube 68 for leading liquid and gas, respectively, to the outlet valve 64. A closable connection to a source of pressure gas is indicated by 69; liquid 62 can be introduced through the connection 69 as well. A turnable handle for closing and opening the valve 64, respectively, is indicated by 70.

In FIGS. 12 and 13, the handle 70 is turned to closed position and presses a movable spindle 71 of the valve 64, through springs 72, e.g. plate springs, to close both the connection from the liquid outlet 67*a* to the outlet 73 leading to the hose 65, by mutual engagement between a conical surface 74 and an annular edge 75 in the valve housing, and the connection from the gas outlet 68*a* to the outlet 73 leading to the hose 65, in a corresponding manner by means of a conical surface 77 of a valve pin 76 and an annular edge 78 in the valve spindle 71, as shown in FIG. 13.

In FIGS. 14 and 15, the handle 70 has been turned loose and the liquid pressure has driven the valve spindle 71 off the annular edge 75, while compressing the spring 72, so that a liquid connection 67*a*–73 has opened, between the conical surface 74 and the annular edge 75. The gas connection from 68*a* to the outlet 73, via a bore 79 in the valve spindle 71, is still closed.

In FIGS. 16 and 17, the pressure in the container 61 has fallen so much, that the springs 72 press the spindle 71 somewhat back, i.e. downwards in the figures so that the annular edge 78 of the spindle 71 comes off the conical surface 77 of the valve pin 76, which is axially locked to the handle 70, whereat a gas connection 68*a*–80 (between the conical surface 77 and the edge 78)-79-73 is opened. A mixture of gas, indicated by 81 in FIG. 16, and liquid is sprayed out through the hose 65 and through the spray head 66, and thanks to that it is possible to obtain an effective spray with a good penetration power in spite of a relatively low remaining pressure in the container 61. In this stage, the spray can be limited to the central nozzle of the spray head 66.

FIGS. 18 and 19 show an alternative embodiment where the gas is fed separately through an inner hose 82 to the central nozzle of the spray head.

I claim:

1. Fire-fighting equipment, comprising:

at least one hydraulic accumulator means (61) for charging to a high initial drive pressure that becomes a reduced drive pressure during use, delivering liquid at the high initial drive pressure and delivering a mixture of liquid and gas at the reduced drive pressure, the hydraulic accumulator means (61) comprising a liquid space (62) and a gas space (63) that communicate with outlet valve means (64) and an outlet line (65), the outlet valve means (64) being responsive to the drive pressures in the liquid space (62) for opening a liquid outlet connection (**67*a*-73-65) only in response to the high drive pressure in the liquid space (62) and opening the liquid outlet connection and a gas outlet connection (68*a*-80-79-73-65) in response to the reduced drive pressure in the liquid space (62**).

2. The fire-fighting equipment according to claim 1, wherein the liquid space (62) and the gas space (63) are not divided from each other by a membrane.

3. The fire-fighting equipment according to claim 2, wherein the outlet valve means (64) comprises a valve spindle (71) and a valve pin (76), a spring (72) being arranged between the valve spindle and the valve pin, whereby the force of the spring (72) is arranged to open the additional gas outlet connection (**68*a*-80-79-73-65**) when the pressure drops from the high pressure to the reduced pressure by moving the spindle in relation to the valve pin.

4. The fire-fighting equipment according to claim 3, and further comprising a manually operable handle (70) for opening the outlet valve means (64) and closing the same.

5. In fire-fighting equipment having a drive unit for supplying extinguishing liquid, the improved drive unit comprising:

at least one hydraulic accumulator means (61) in which a high initial drive pressure falls to a reduced drive pressure in use for supplying the extinguishing liquid at the high initial drive pressure and a mixture of the extinguishing liquid and a gas at the reduced drive pressure, the hydraulic accumulator means comprising a liquid space (62) for the extinguishing liquid and a gas space (63) for the gas that each communicate through an outlet valve means (64) with an outlet line means (65) for the use, the outlet valve means (64) being responsive to the high initial drive pressure and reduced drive pressure for opening only a liquid outlet connection (**67*a*-73-65) at the high initial drive pressure and opening also a gas outlet connection (68*a*-80-79-73-65**) therein at the reduced drive pressure.

6. The fire-fighting equipment according to claim 5, wherein the outlet line means intermixes the gas and the extinguishing liquid.

7. The fire-fighting equipment according to claim 5, wherein the outlet line means passes the gas through an inner line and the extinguishing liquid through a separate outer line about the inner line for the use.

* * * * *